US008225716B2

(12) United States Patent
Ruhmke et al.

(10) Patent No.: US 8,225,716 B2
(45) **Date of Patent: *Jul. 24, 2012**

(54) PRINTING UNIT OF A PRINTING PRESS, COMPRISING AT LEAST TWO FRAME PARTS, THE POSITIONS OF WHICH RELATIVE TO ONE ANOTHER CAN BE CHANGED

(75) Inventors: Holger Wilfried Fritz Ruhmke, Zell (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 46 days.
This patent is subject to a terminal disclaimer.

(21) Appl. No.: 12/737,972

(22) PCT Filed: Aug. 18, 2009

(86) PCT No.: PCT/EP2009/060646

§ 371 (c)(1),
(2), (4) Date: Mar. 4, 2011

(87) PCT Pub. No.: WO2010/026040

PCT Pub. Date: Mar. 11, 2010

(65) Prior Publication Data

US 2011/0162544 A1 Jul. 7, 2011

(30) Foreign Application Priority Data

Sep. 5, 2008 (DE) ..... 10 2008 041 842

(51) Int. Cl.
*B41F 33/00* (2006.01)
*B41F 13/00* (2006.01)

(52) U.S. Cl. ..... 101/480; 101/479; 101/216

(58) Field of Classification Search ..... 101/180, 101/182, 216, 219, 221, 249, 480, 479, 217, 101/218; 340/686.1, 686.6
See application file for complete search history.

(56) References Cited

U.S. PATENT DOCUMENTS 5,025,726 A 6/1991 Funabashi et al.
(Continued)

FOREIGN PATENT DOCUMENTS

DE 200 11 699 1/2002
DE 102 24 031 B3 1/2004
(Continued)

OTHER PUBLICATIONS

"Industrial Safety Systems; Safety laser scanners for increased dynamism and efficiency", SICK/Sensor Intelligence, SICK AG, Waldkirch, Germany, www.sick.com, Apr. 2006, 25 pp.

*Primary Examiner* — Ren Yan
*Assistant Examiner* — Marissa Ferguson Samreth
(74) *Attorney, Agent, or Firm* — Mattingly & Malur, P.C.

(57) ABSTRACT

A printing unit of a printing press is composed of at least two frame parts, the position of at least one of which, relative to the other, can be changed. Cooperating ones of these frame parts are placed against each other along a common joining surface, in a first operational position. These frame parts are separated from each other in a second operational position. An interstice, that is partly defined by these frame parts, is formed between the separated frame parts in the printing unit. At least one of the cooperating frame parts is supported so that it is movable along an adjustment path. At least one sensor is provided and is usable to monitor the interstice. The sensor has orientation characteristics or a sensory range along the joining surface. A control unit is provided and is connected to the at least one sensor. At least one drive unit is assigned to at least one of the cooperating frame parts and is usable to change the frame parts from one operational procedure into the other operational procedure. A control element is arranged in a control system and is usable to supply power to the first drive unit that is controlled by the control unit in accordance with a signal which is supplied by the sensor that is monitoring the interstice. The control element is also able to activate the first drive unit and is controllable independently from the activation of the first drive unit. A functional position of the control element blocks a relative movement between the frame parts with that functional position being selected by the control unit.

37 Claims, 5 Drawing Sheets

U.S. PATENT DOCUMENTS

| | | | | |
|---|---|---|---|---|
| 5,060,569 | A * | 10/1991 | Gladow | 101/216 |
| 5,782,182 | A | 7/1998 | Ruckmann et al. | |
| 7,707,936 | B2 | 5/2010 | Schneider et al. | |
| 7,779,757 | B2 | 8/2010 | Schafer et al. | |
| 2001/0037743 | A1 * | 11/2001 | Takahashi | 101/477 |
| 2004/0089177 | A1 * | 5/2004 | Stiel | 101/218 |
| 2009/0095178 | A1 | 4/2009 | Schwitzky et al. | |

FOREIGN PATENT DOCUMENTS

| | | | |
|---|---|---|---|
| DE | 10 2004 037 888 | A1 | 10/2005 |
| EP | 0 444 227 | A1 | 9/1991 |
| EP | 1 524 115 | A2 | 4/2005 |
| EP | 1 790 474 | A1 | 5/2007 |
| FR | 2 648 506 | | 12/1990 |
| WO | 95/24314 | | 9/1995 |
| WO | 2005/037553 | A1 | 4/2005 |

* cited by examiner

PRINTING UNIT OF A PRINTING PRESS, COMPRISING AT LEAST TWO FRAME PARTS, THE POSITIONS OF WHICH RELATIVE TO ONE ANOTHER CAN BE CHANGED

CROSS-REFERENCE TO RELATED APPLICATIONS

This application is the U.S. national phase, under 35 U.S.C. 371, of PCT/EP2009/060646, filed Aug. 18, 2009, published as WO 2010/026040 A1 on Mar. 11, 2010, and claiming priority to DE 10 2008 041 842.0, filed Sep. 5, 2008, the disclosures of which are expressly incorporated herein by reference.

FIELD OF THE INVENTION

The invention relates to a printing unit of a printing press comprising at least two frame parts, the position of which relative to one another can be changed. Interacting frame parts are placed against each other along a shared joining surface in a first operating position and are moved away from each other in a second operating position. Between the frame parts, that are moved away from each other in the printing unit, an intermediate space is formed. This intermediate space is delimited, in part, by the frame parts. At least one of the frame parts is movable along an adjustment plate. At least one sensor, for use in monitoring the intermediate space, is provided. The sensor has a directional characteristic along the joining surface or has a sensing zone effective along the joining surface. A control unit is connected to the sensor.

BACKGROUND OF THE INVENTION

WO 95/24314 A1 and WO 2005/037 553 A1 each describe a printing unit of a printing press comprising at least two frame parts, the position of which relative to one another can be changed, wherein interacting frame parts are placed against one another in a first operating position, and are moved away from one another in a second operating position, wherein between frame parts that have been moved away from one another, an intermediate space, delimited in part by said frame parts, is formed in the printing unit, wherein at least one printing couple cylinder is mounted in each of the respectively interacting frame parts.

EP 1 790 474 A1 describes a printing press comprising a printing unit with one stationary frame part and at least one frame part that is movable along a linear adjustment path, wherein the stationary frame part has at least one printing couple, wherein at least one inking unit is arranged in the movable frame part, wherein in a first operating position interacting frame parts are placed against one another and in a second operating position said parts are moved away from one another, wherein between frame parts that have been moved away from one another, an intermediate space, delimited in part by said frame parts, is formed, wherein a safety apparatus is provided, which uses a detection device disposed on the movable frame part to detect the presence of an obstacle in the adjustment path of said movable frame part.

EP 0 444 227 A1 describes a printing press comprising a printing unit having at least two frame parts, the position of which relative to one another can be changed, wherein printing couple cylinders are arranged in a stationary frame part, and at least one inking unit is arranged in the at least one movable frame part, wherein in a first operating position, interacting frame parts are placed against one another and in a second operating position said frame parts are moved away from one another, wherein between frame parts that have been moved away from one another, an intermediate space, delimited in part by said frame parts, is formed in the printing unit, wherein mat switches are provided, which prevent the printing couple cylinders from rotating, for example, when a person steps on one of said mat switches while the frame parts are in the operating position in which they are moved away from one another.

DE 102 24 031 B3 describes a device for monitoring a scanning zone of a working apparatus, said device comprising at least one redundant camera system consisting of two cameras and a beam splitter positioned upstream thereof, via which images of the scanning zone can be displayed on both cameras for detecting objects that may pose a safety risk within at least one safety zone, and comprising two computer units, wherein each computer unit is connected to one of the cameras for evaluating the image data acquired there, and wherein the two computer units are coupled to one another for the purpose of mutual verification, and comprising at least one switch output actuated by the computer units, via which output the working apparatus is placed in operation only if no object that may pose a safety risk is found within the safety zone.

DE 10 2004 037 888 A1 describes a printing unit of a web-fed rotary printing press, which comprises two frame sections, mounted so as to be movable in relation to one another, each having at least one printing couple with at least two interacting printing couple cylinders, wherein the printing couple cylinders are mounted with each cylinder end disposed in a bearing unit having at least one actuator, wherein each printing couple cylinder can be radially displaced in its respective bearing unit by means of the actuator, wherein the actuator is embodied as an adjustment means which is actuable via a pressurized medium, such as oil.

DE 200 11 699 U1 describes a printing press with an impression cylinder and at least one printing couple assigned to said cylinder, which printing couple comprises at least two bearings with socket-type supports for the interchangeable installation of tubular printing equipment parts, and an inking unit, wherein the bearing and the inking unit are supported so as to be displaceable with respect to their distance from the impression cylinder along at least one guide rail, and wherein the socket-type supports of the bearing can optionally be loaded with a selection of equipment parts on the basis of the printing technique and/or printing format, wherein the bearing and the inking unit are displaceable between an operational position, a switching position and an off-line position, wherein the bearing and the inking unit are displaceable on the guide rails, embodied as toothed racks, by means of an allocated servo motor, for displacement to the respective operational position, switching position and off-line position.

U.S. Pat. No. 5,025,726 A describes a printing unit of a rotary printing press having two frame sections, one of which is movable in relation to the other, wherein a locking system is provided.

FR 2 648 506 A1 describes a variable-width safety barrier for blocking off a hazardous area.

The documentation of the SICK AG company in D-79183 Waldkirch, Germany, describes safety laser scanners, product number 8010739, and the use thereof, wherein the publication date of said documentation is listed as 1 Apr. 2006.

SUMMARY OF THE INVENTION

The problem addressed by the invention is that of devising a printing unit for a printing press, comprising at least two frame parts, the position of which relative to one another can be changed, wherein a hazard posed by at least one moved frame part of said printing unit to a press operator working in the hazardous area of said printing unit is prevented.

The problem is solved according to the invention by a printing unit having at least one drive unit which is assigned to at least one of the interacting frame parts. The drive unit is usable to change the at least one movable frame part from one operating position to the other operating position. A control element is arranged in a conduit system that is usable for supplying power to the first drive unit. The control element is controlled by the control unit on the basis of a signal from the sensor which monitors the intermediate space. The control element is additionally provided for activating the first drive unit and is controlled independently of the activation of the first drive unit. A functional position of the control element, which can be selected by the control unit, prevents relative movement between the frame parts.

The benefits to be achieved by the invention consist particularly in that the printing unit offers a high level of operational safety. In particular, the printing unit has a safety device which helps to prevent a hazard posed by at least one moved frame part of said printing unit to a press operator working in a hazardous area of said printing unit.

BRIEF DESCRIPTION OF THE DRAWINGS

Embodiment examples of the invention are illustrated in the drawings and are described in greater detail in what follows.

The drawings show.

DESCRIPTION OF THE PREFERRED EMBODIMENT

Figure 1:
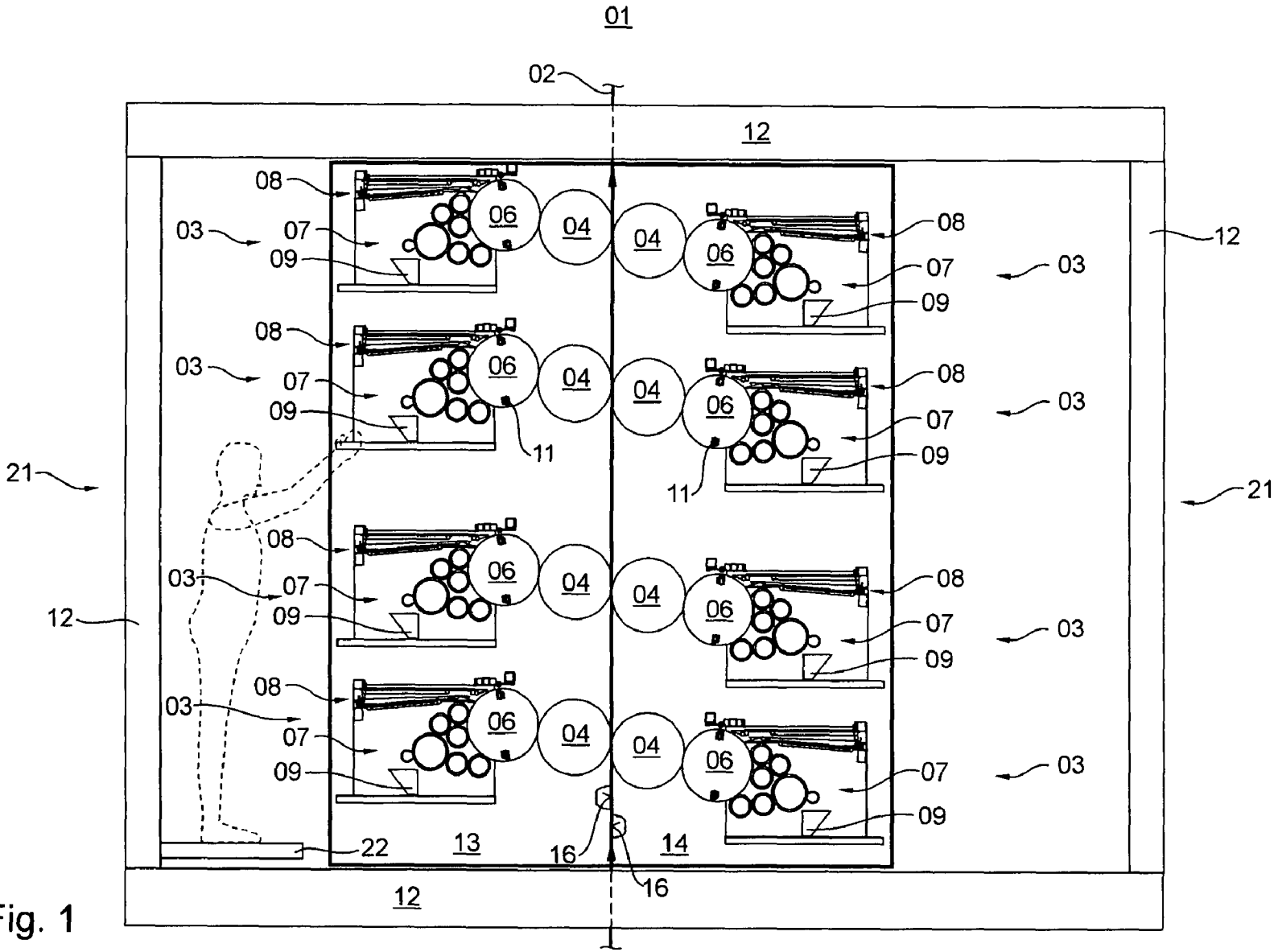
FIG. 1 a printing unit comprising two frame parts, the position of which relative to one another can be changed, in a first operating position.
Figure 2:
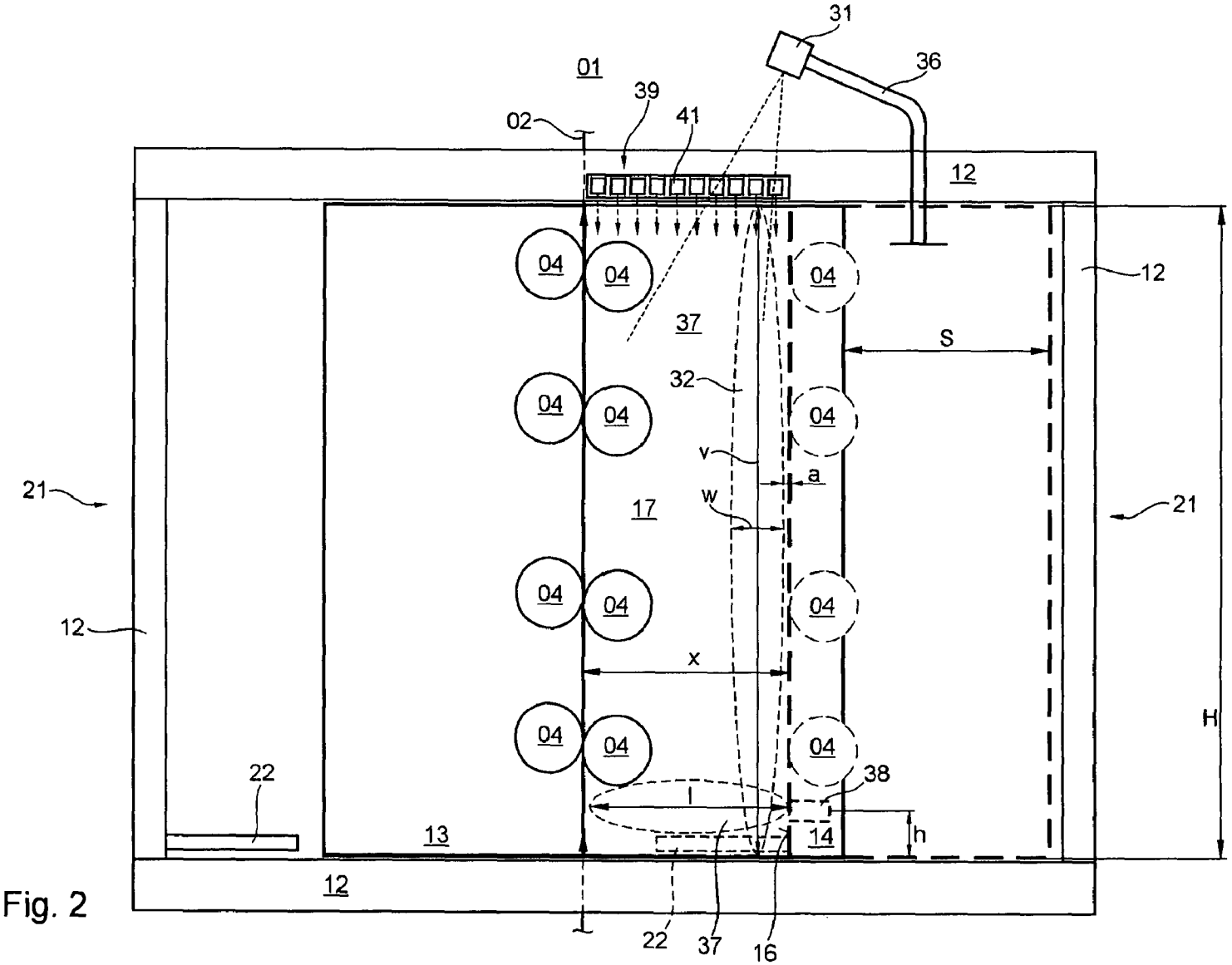
FIG. 2 the printing unit of FIG. 1, with its frame parts in a second operating position.

FIGS. 1 and 2 each illustrate, by way of example, a printing unit 01, embodied as a tower, particularly as an eight-couple tower, enclosed inside a frame 12 embodied, for example, as a structural framework, for a rotary printing press, which is preferably usable for color newspaper printing, wherein the printing unit 01 is highly compact in configuration, i.e., particularly having a low structural height. Two eight-couple towers of this type may also be placed one on top of the other to form a printing unit 01 embodied as a 16-couple tower. A preferably web-type print substrate 02, for example, a paper web 02, to be imprinted in the printing unit 01 is preferably guided substantially vertically through the printing unit 01. Preferably a plurality of printing couples 03 are arranged preferably on each side of the paper web 02, wherein each of said printing couples 03 has at least one printing couple cylinder 04, particularly transfer cylinder 04, and preferably one forme cylinder 06, which interacts with the transfer cylinder 04. Each printing couple 03 is also equipped with a preferably keyless inking unit 07 having multiple rollers, for example, an anilox inking unit 07 having a screen roller, wherein the rollers of the inking unit 07 draw ink from an ink reservoir 09 and form it into a thin ink film, evening out the thickness of said ink film, and transport said film to the respective forme cylinder 06 for the purpose of applying it to at least one printing forme arranged on the forme cylinder 06. The respective forme cylinder 06 of each of the printing couples 03 has an axial length of between 1,000 mm and 4,000 mm, for example, preferably between 1,200 mm and 2,600 mm, particularly between 1,600 mm and 2,100 mm, and preferably holds a plurality of printing formes, for example, four or six, side by side in its axial direction, wherein the respective subject of each printing forme is assigned to a specific page of the printed product to be produced by the rotary printing press, for example, a newspaper. The axial length of the transfer cylinder 04 is adapted to the respective forme cylinder 06 that interacts with it. The transfer cylinder 04 and the respective forme cylinder 06 can have the same circumference (FIGS. 1 and 2), or the circumferential length of the forme cylinder 06 is about one-half the size of the assigned transfer cylinder 04. The rotary printing press illustrated by way of example in FIGS. 1 and 2 prints, for example, in an offset printing process, preferably in a dry offset printing process, i.e., in an offset printing process that does not use a dampening agent, therefore the printing couples 03 depicted in FIGS. 1 and 2 do not have dampening units.

In the preferred embodiment, at least one, and particularly each, of the printing couples 03 of the printing unit 01 has a printing forme magazine 08, wherein each respective printing forme magazine 08 is assigned to the forme cylinder 06 of the respective printing couple 03. Each printing forme magazine 08 has at least one storage position for storing at least one printing forme, wherein each storage position is preferably embodied in a chute or as a chute, wherein said chute preferably has a transport device, for example, remotely actuable, for supplying at least one new printing forme to the forme cylinder 06. Each printing forme magazine 08 preferably also has a chute with an also preferably remotely actuable transport device for removing at least one used printing forme from the forme cylinder 06.

The printing formes are each fastened to the respective forme cylinder 06 by means of a retaining device, for example, a clamping device, preferably remotely actuable, arranged in the respective forme cylinder 06. The retaining device is embodied as pneumatically actuable, for example, and is arranged in a groove 11 in the respective forme cylinder 06, wherein said groove 11 extends in the axial direction of the relevant forme cylinder 06.

The frame 12 of the printing unit 01 consists, for example, of one lower and one upper support, each arranged horizontally, and, for example, two side frames, preferably arranged vertically between these two supports, wherein supports and side frames together form a frame, for example, which holds the printing unit 01, preferably encompassing it. The lower support can be embodied to act as the preferably substantially rectangular base plate of the printing unit 01, whereas the upper support forms a cover plate for the printing unit 01, for example. The printing unit 01 encompassed by said frame 12 has at least two frame parts 13; 14, the position of which relative to one another can be changed, wherein one of said frame parts 13 is preferably embodied as stationary in the shared frame 12 (in FIGS. 1 and 2, the left frame part 13, for example), whereas at least one other frame part 14 that interacts with the stationary frame part 13 (in FIGS. 1 and 2, the right frame part 14, for example) is arranged in the shared frame 12 so as to be movable, particularly positionable, bidirectionally, for example, parallel to the lower and upper supports, along a preferably linear adjustment path S between two end points that delimit the adjustment path. Because at least one of the interacting frame parts 13; 14, which have a substantially rectangular base surface, is movable, the frame parts 13; 14 have two different operating positions, wherein in a first operating position the frame parts 13; 14 are placed against one another along a shared joining surface 16 which extends across the height H and width B of the printing unit 01 (FIGS. 1, 2 and 4), and in a second operating position, the frame parts are moved away from one another (FIG. 2). The second operating position of the movable frame part 14 is indicated by dashed lines in FIG. 2. The shared joining surface 16 between the interacting frame parts 13; 14 is illustrated in FIG. 1 by way of example as two cut-outs. In a first operating position, the frame parts 13; 14, the position of which relative to one another can be changed, are placed directly against one another, with no intermediate space 17, wherein in this first operating position, the at least one movable frame part 14 can be locked in position, at least at the relevant end point of the adjustment path S, preferably via remote actuation, to prevent it from moving unintentionally. The joining surface 16 between frame parts 13; 14 placed against one another, formed in the first operating position, coincides, for example, with a transport plane of the paper web 02, which is preferably guided vertically through the printing unit 01. In the second operating position, the interacting frame parts 13; 14, the position of which relative to one another can be changed, are moved away from one another such that their respective sides that face the paper web 02 being guided through the printing unit 01 are opposite one another in parallel. During the changeover from the first operating position to the second operating position, the width of the preferably rectangular-shaped intermediate space 17 present between the interacting frame parts 13; 14 can be changed between a minimal value, preferably zero, and a maximum value of 1 m to 2 m, for example.

At least one printing couple cylinder 04, particularly embodied as transfer cylinder 04, is mounted in each of the interacting frame parts 13; 14, wherein when the interacting frame parts 13; 14 are in the first operating position, the at least one printing couple cylinder 04, mounted in the frame part 13 which is stationarily positioned in the frame 12, for example, can be placed against the at least one printing couple cylinder 04 mounted in the other frame part 14 which is movably positioned in the frame 12, for example, thereby forming a shared print position that imprints the paper web 02 particularly on both sides. In the second operating position, in which the two frame parts 13; 14, the position of which relative to one another can be changed, are moved away from one another, an intermediate space 17, delimited in part by the frame parts 13; 14, is formed between these two frame parts 13; 14 in the printing unit 01, particularly within the structural frame thereof, wherein said intermediate space 17 is then freely accessible and passable to press operators of the printing unit 01, at least when the frame part 14 which is movably arranged in the frame 12 has reached the end point at which it is the maximum distance from the joining surface 16 formed with the stationary frame part 13 (FIG. 2). The at least one movable frame part 14 can also be locked in place in its second operating position, particularly at the relevant end point of the adjustment path S, to prevent it from moving unintentionally. In the preferred embodiment, a plurality of printing couples 03, particularly four, are arranged in each of the interacting frame parts 13; 14. Each of the interacting frame parts 13; 14, particularly movable frame part 14, has a mass of 30 tons or more, for example.

On one operating side 21 of at least one of the frame parts 13; 14, a height-adjustable operator's platform 22 is arranged, for example, to facilitate access by press operators working on the printing unit 01 to the upper printing couples 03 of the printing unit 01. The operating side 21 of the respective frame part 13; 14 is located on the side thereof that faces away from the transport plane of the paper web 02 being guided through the printing unit 01. Additionally or alternatively, a height-adjustable operator's platform 22 that can also be lowered into the base plate is also arranged, for example, in the intermediate space 17 which is delimited in part by the interacting frame parts 13; 14.

To allow the movable frame part 14 to be moved, said part is mounted, for example, in a linear bearing and/or is guided in such a bearing as it is being moved. For implementing the movement of the frame parts 13; 14, the position of which relative to one another can be changed, at least one drive unit 23 is provided, which is assigned to at least one of the interacting frame parts 13; 14 to change it from one operating position to the other operating position. As was described above, at least one printing couple cylinder 04 is mounted in each of the interacting frame parts 13; 14, wherein at least a second drive unit 24 is provided for implementing a radial movement of the respective printing couple cylinder 04, wherein the radial movement of the respective printing couple cylinder 04 particularly has an orthogonal component relative to the joining surface 16 of the frame parts 13; 14. The printing couple cylinders 04 arranged in the same frame part 13; 14 can be moved radially by the respective second drive unit 24, all together, or each selected individually.

Figure 3:
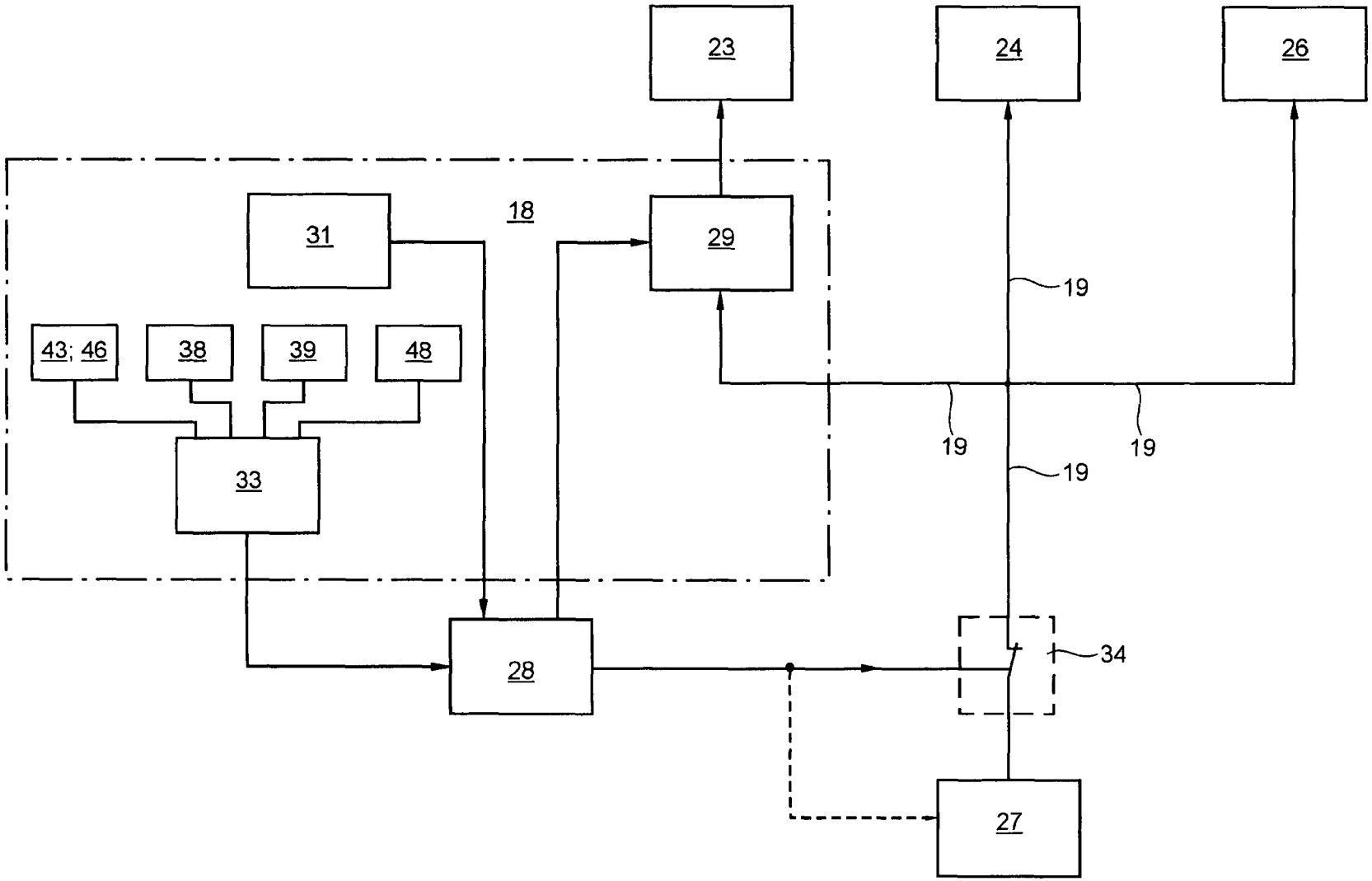
FIG. 3 a block diagram.

Each of the drive units 23; 24 has, for example, at least one operating cylinder that can be acted on by a pressurized medium, wherein to reduce energy costs, both drive units 23; 24 and preferably also a locking system 26 for latching or locking the relevant movable frame parts 13; 14 in place in their respective operating positions, i.e., particularly at the respective end points of the relevant adjustment path S, are preferably supplied with power, for example pressurized hydraulic fluid, from a shared energy storage device 27, particularly from the same hydraulic unit 27, so that only a single conduit system 19 is required for supplying power to the two drive units 23; 24, and if applicable to the locking system 26, in the printing unit 01 (FIG. 3). The hydraulic unit 27 has, for example, a compressor or a pump. The supply of power to at least one of the two drive units 23; 24 and to the locking system 26 can preferably be remotely actuated, for example, from a preferably electronic control unit 28, particularly from a control center 28 belonging to the printing unit 01, wherein the two drive units 23; 24 and the locking system 26 can each be actuated individually and independently of one another. The hydraulic unit 27 pressurizes the operating cylinder of the drive units 23; 24 with a pressure of, for example, 100 bar to 500 bar. The functional units connected to the same hydraulic unit 27 as the two drive units 23; 24 and the locking system 26 are switched to pressureless or pressurized, for example, by means of the same controllable control element 34, for example, valve 34, which is particularly controlled by the control unit 28, wherein said valve 34 is assigned directly to the output of the hydraulic unit 27 and is arranged upstream of a branch of the conduit system 19 that distributes the pressure to connected functional units, so that the respective functional position of the control element 34 affects all elements supplied with pressure from the hydraulic unit 27 (FIG. 3).

Because the intermediate space 17 that is formed between the frame parts 13; 14, the position of which relative to one another can be changed, in the second operating position thereof allows access, preferably even full-body access, to press operators working with the printing unit 01, in order to protect a press operator who might enter the intermediate space 17 or might reach into the intermediate space 17 with one of his body parts, a safety device 18 is provided in or on the printing unit 01 (FIG. 3), to prevent bodily injury, particularly crushing injuries, that could occur when the movable frame part 14 is placed in motion by the first drive unit 23, which is activated by the control unit 28, for example, particularly automatically, i.e., in a program-controlled system. The safety device 18 has, for example, at least one additional control element 29, for example, valve 29, also arranged in the system for supplying power for actuating the first drive unit 23, and controlled separately by the control unit 28, for example, with said valve having a functional position that can be selected by the control unit 28, in which position, for example, in the event of a malfunction occurring in the conduit system 19 for supplying power, for example, in the case of a circuit malfunction, relative movement between the frame parts 13; 14 is prevented, i.e., the movable frame part 14 is prevented from moving, for example, toward the stationary frame part 13, which could endanger a press operator working in the intermediate space 17 between the frame parts 13; 14, the position of which relative to one another can be changed. The selected functional position of this control element 29, which is particularly controlled by the control unit 28 separately and independently from the control of the first drive unit 23, affects only the operability of the first drive unit 23. In order for the first drive unit 23 to be operable, the supply of pressurized medium to it must be enabled by the control element 29, which is preferably controlled directly by the control unit 28. If this supply of pressurized medium is prevented or withdrawn by the control element 29, the first drive unit 23 is not operable, irrespective of the commands from its selection.

The safety device 18 preferably also has at least one detection device 31, particularly a sensor 31, for example, attached to the movable frame part 14, which sensor detects and monitors, in a contactless manner, the presence and/or movement of a body that does not belong to the printing unit 01, i.e., particularly the presence and/or movement of a person, in the intermediate space 17, preferably embodied as rectangular-shaped and having a variable width, between the frame parts 13; 14, the position of which relative to one another can be changed. The sensor 31 preferably works with electromagnetic waves, for example, with light or microwaves (radar system), or ultrasonic waves, and is embodied, for example, as a video camera suitable for monitoring a room, or as a motion detector, wherein the motion detector is embodied, for example, as a passive infrared detector. The sensor 31, embodied as a camera or as a motion detector, can be attached, for example, in or on the upper support of the frame 12, which is embodied as a cover plate. Another variant provides that particularly the sensor 31, embodied as a camera or as a motion detector, is preferably permanently affixed to the movable frame part 14, for example, by means of a support arm 36 that is attached to said frame part 14 and supports the sensor 31, wherein the sensing zone 37 of the sensor 31 is directed into the intermediate space 17 (FIG. 2). The sensor 31 is connected to the control unit 28, particularly to the control center 28 belonging to the printing unit 01, at least for purposes of data transfer. As soon as the sensor 31 detects the presence and/or movement of a person in the intermediate space 17, while the first drive unit 23 that drives the movable frame part 14 is actuated, the movement of the first drive unit 23 is immediately halted via the control element 29 acting on said drive unit 23, and the direction of movement of the frame part is optionally reversed. When a person is detected in the hazardous area, for example, the movable frame part 14 can be brought to a halt almost instantaneously, within an adjustment path S of fewer than 5 mm, for example, by an actuation of at least one of the control elements 29; 34 by switching off the first drive unit 23, i.e., switching it to pressureless, and/or by activating a brake device actuated by the control unit 28.

FIG. 3 illustrates, by way of example in a block diagram, the interaction of the at least one sensor 31, the control unit 28, the control elements 29; 34, the energy storage device 27, the drive units 23; 24 and the locking system 26, wherein the respective direction of action is indicated in each case by an arrow, wherein particularly the sensor 31 and the control element 29 arranged in the conduit system 19 to the first drive unit 23 are assigned to the safety device 18. The control unit 28 verifies the functional readiness and/or functionality of the sensor 31, preferably on a continuous basis. If the sensor 31 is not functionally ready and/or functional, the control unit 28 will prevent a release for initiating a movement of the movable frame part 14, or the control unit 28 will stop the first drive unit 23 that drives the movable frame part 14 by issuing a corresponding control command, for example, to the valve 34 assigned to the energy storage unit 27 and/or to the energy storage unit 27 itself, wherein the latter variant is indicated in FIG. 3 by a dashed directional arrow. If the sensor 31 is not functionally ready and/or functional, alternatively or in addition to controlling the first drive unit 23 and/or at least one of the control elements 29; 34, the control unit 28 can then actuate the locking system 26 that locks the movable frame part 14 in place.

Figure 4:
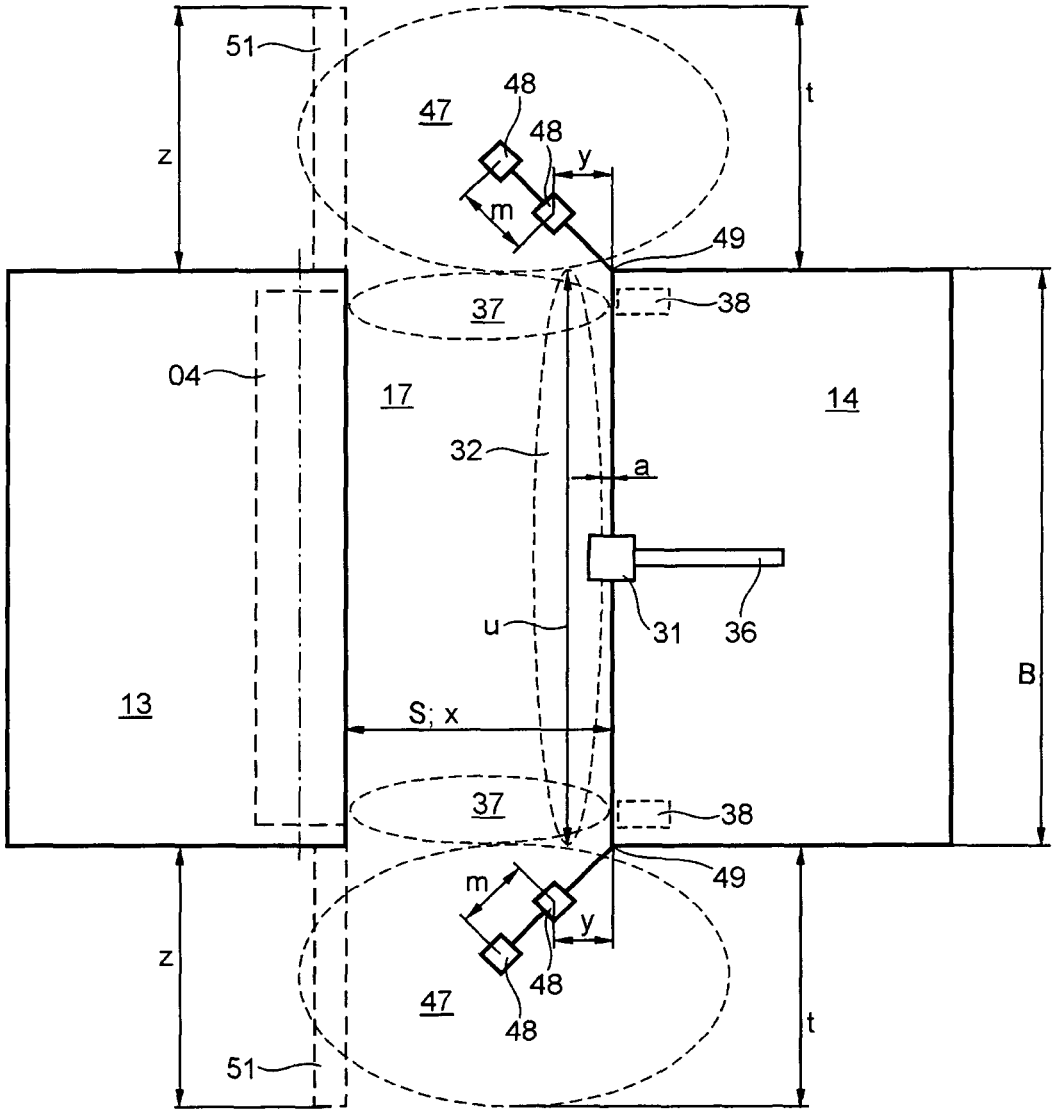
FIG. 4 variants for monitoring the intermediate space formed between frame parts of the printing unit, and variants of an access control device.
Figure 5:
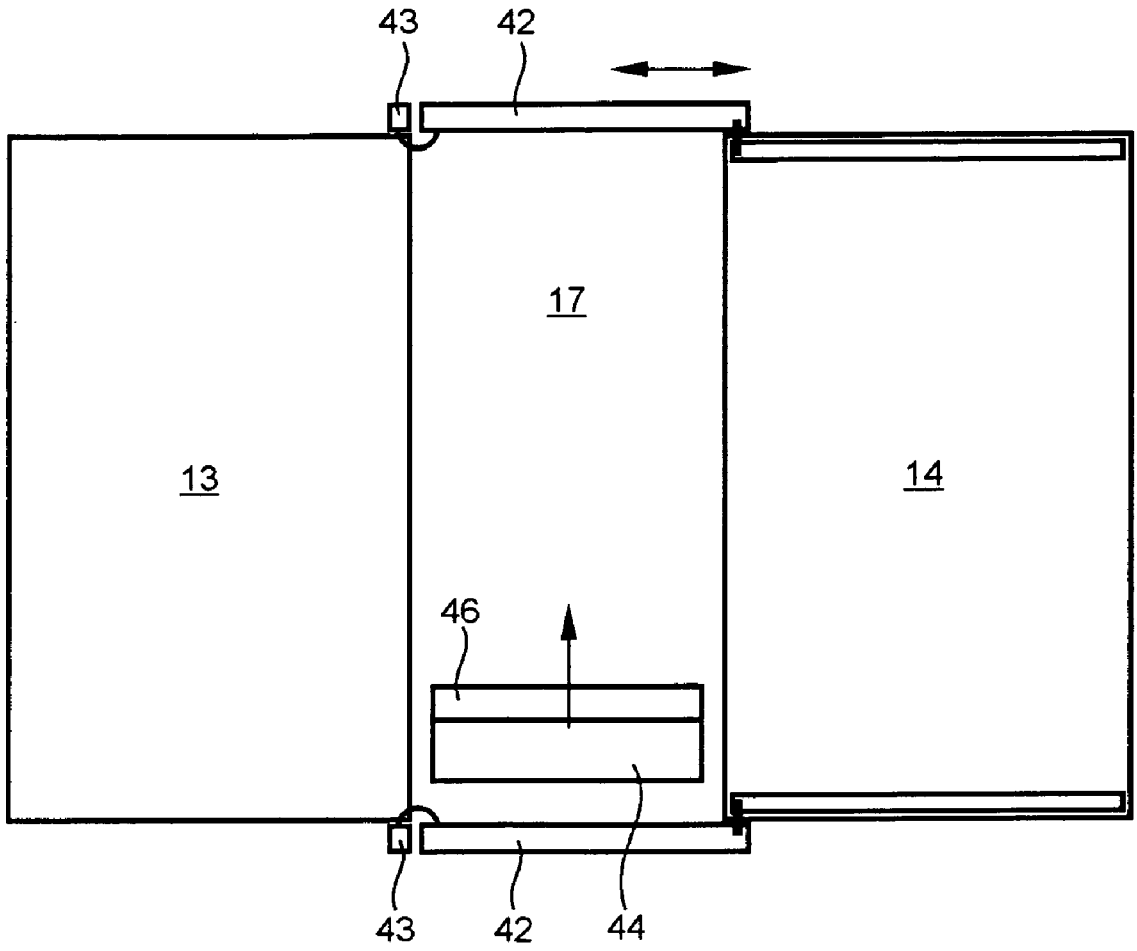
FIG. 5 another variant of the access control device.

FIGS. 4 and 5 each show, in a simplified illustration, a plan view of the printing unit 01 depicted in FIGS. 1 and 2, with the frame parts 13; 14, the position of which relative to one another can be changed within the frame 12.

In one advantageous embodiment, the at least one sensor 31, which monitors the intermediate space 17 between the frame parts 13; 14, the position of which relative to one another can be changed, has a directional characteristic 32 along the joining surface 16 of said frame parts, for example, which characteristic extends like a curtain within the intermediate space 17, preferably a very short distance a, in the range of a few millimeters to at most a few centimeters, for example, particularly in front of the movable frame part 14, wherein a field width w of a first angular field of the directional characteristic 32 or of the sensing zone 37 of the sensor 31, said width being directed parallel to the adjustment path S of the movable frame part 14, is preferably much smaller than a field width u; v, orthogonal thereto, of a second and/or third angular field of said directional characteristic 32 or said sensing zone 37, wherein the field width u of the second angular field of the directional characteristic 32 is oriented in the axial direction of the at least one printing couple cylinder 04 mounted in the movable frame part 14 (FIG. 4), and the field width v of the third angular field of the directional characteristic 32 or the sensing zone 37 is oriented in the direction of a height H of the movable frame part 14 (FIG. 2). The directional characteristic 32 or the sensing zone 37 are therefore heavily concentrated at least in a direction in space which is opposite at least one of the two other orthogonal directions in space, and therefore the directional characteristic 32 or the sensing zone 37 preferably extends flat along the joining surface 16 of the movable frame part 14. The field width u of the second angular field of the directional characteristic 32 or the sensing zone 37, which width is oriented in the axial direction of the at least one printing couple cylinder 04, and/or the field width v of the third angular field of the directional characteristic 32 or the sensing zone 37, which width is oriented in the direction of the height H of the movable frame part 14, can each be widened using an optical system, for example, particularly a system of lenses. The second angular field of the directional characteristic 32 or of the sensing zone 37, which angle is oriented in the axial direction of the at least one printing couple cylinder 04 mounted in the movable frame part 14, can be opened up to the height H of said frame part 14, and the third angular field of the directional characteristic 32 or of the sensing zone 37, oriented in the direction of the height H of the movable frame part 14, can be opened over an entire width B of the movable frame part 14, said width extending in the axial direction of the printing couple cylinder 04 mounted in the movable frame part 14 (FIG. 4). In FIG. 4, which provides a plan view of the printing unit 01, in the interest of clarity, the at least one printing couple cylinder 04 with its rotational axis indicated is shown in only one frame part, namely the stationary frame part 13, even though at least one printing couple cylinder 04 is also mounted in the movable frame part 14 (see FIG. 2).

In another variant, the at least one sensor 31 that monitors the intermediate space 17 is arranged so as to pivot, so that the sensing zone 37 of the sensor 31, which in this variant is preferably embodied as beam-shaped and therefore narrow, extends along the joining surface 16 formed between the frame parts 13; 14, the position of which relative to one another can be changed, as a result of a preferably periodic pivoting movement of said sensor 31, wherein in this variant, the sensor 31 is preferably embodied as at least one laser, wherein the laser emits a beam having a narrow diameter of, for example, fewer than 2 mm, and scans a scanning zone defined by the pivoting movement of said sensor 31. Therefore, irrespective of the practical embodiment of the sensor 31, the sensing zone 37 of said sensor 31 can execute a pivoting movement, wherein the sensing zone 37 extends along the joining surface 16 formed between the frame parts 13; 14, the position of which relative to one another can be changed.

It is also advantageous to provide that the control unit 28 which is connected to the sensor 31 activates and/or evaluates the signals from the at least one sensor 31 that monitors the intermediate space 17, which is preferably embodied as rectangular in shape and particularly having a variable width, on the basis of the operating positions of the interacting frame parts 13; 14. In this case it is particularly provided that, when the frame parts 13; 14, the position of which relative to one another can be changed, are moving toward one another, the control unit 28 switches the sensor 31 to mute once a predefined distance x between said frame parts 13; 14 is reached, i.e., that the control unit 28 does not evaluate the sensor's signal elicited by the detection of a frame part 13; 14 as a malfunction, and therefore also does not halt the movement of the frame parts 13; 14, the position of which relative to one another can be changed. The distance x at which the control unit 28 switches the sensor 31 to mute is selected to be greater than a field width w of the directional characteristic 32 or of the sensing zone 37 of the sensor 31, wherein said field width w is oriented parallel to the adjustment path S of the frame parts 13; 14, the position of which relative to one another can be changed. Switching the sensor 31 to mute can alternatively or additionally be time-dependent, particularly dependent on a duration of the movement carried out by at least one of the frame parts 13; 14, the position of which relative to one another can be changed. In its active time, during which it is switched on, the sensor 31 monitors the intermediate space 17 preferably continuously, with its directional characteristic 32 or its sensing zone 37.

Because once the sensor 31 has been switched to mute there is a danger that the movement of the frame parts 13; 14, the position of which relative to one another can be changed, toward one another in the intermediate space 17 might cause injury to a press operator, for example, to his limbs if these are reaching into the intermediate space 17, the safety device 18 is preferably expanded to include additional components, wherein the control device 28 activates these additional components either no earlier than the start of movement of the frame parts 13; 14, the position of which relative to one another can be changed, and/or no later than simultaneously with the switching of the sensor 31 to mute. These additional components connected to the control unit 28 consist preferably of an access control device 33 (FIG. 3), which controls at least one access point, for example, formed on a longitudinal side of the printing unit 01, to the intermediate space 17 that remains once the sensor 31 has been switched to mute.

The access control device 33 can have one or more photoelectric beam detectors or one or more infrared beam barriers, for example, wherein the respective beam paths of the photoelectric beam detectors or infrared beam barriers are oriented horizontally or vertically, for example. The access control device 33 can perform a control function, for example, over the entire height H of at least the movable frame part 14, or over only one or more portions of this height H.

The access control device 33 can have a scanner 38, arranged, for example, near the base plate, for example, at a height h of up to 200 mm, preferably about 100 mm, which therefore acts in the floor area of the intermediate space 17, wherein the sensing zone 37 of said scanner 38 is oriented substantially parallel to the longitudinal side of the printing unit 01, wherein at least one length l of said sensing zone 37, oriented parallel to the longitudinal side of the printing unit 01, can preferably be adjusted to variable lengths in the control unit 28, wherein said variable length l is adjustable and adjusted particularly on the basis of the distance x formed between the frame parts 13; 14, the position of which relative to one another can be changed (FIG. 2). The distance x ranges, for example, up to 2,000 mm. The base plate of the intermediate space 17 formed between the frame parts 13; 14, the position of which relative to one another can be changed, can also be covered by a pressure sensor mat (not shown), which sends a signal to the control unit 28 when the pressure sensor mat detects the presence of a person in the intermediate space 17 on the basis of the contact of that person with the base.

An additional or alternative embodiment of the access control device 33 can consist, for example, of at least one sensor strip 39, consisting of multiple sensors 41 arranged in a row, and particularly attached to the upper support of the frame 12, with each such strip monitoring one of the access points, formed on a longitudinal side of the printing unit 01, to the intermediate space 17 that is formed between the frame parts 13; 14, the position of which relative to one another can be changed, with said monitoring involving sensing by means of a barrier, for example, a multiple infrared beam barrier, preferably of narrow mesh, and generated, for example, by the sensors 41 in the respective sensor strip 39. The individual sensors 41 of the respective sensor strip 39 can preferably be activated and/or deactivated on the basis of the distance x that is formed between the frame parts 13; 14, the position of which relative to one another can be changed, such that the control unit 28 will evaluate only the signal of those sensors 41 of the sensor strip 39 which are active at a given point in time for the variable-width access point to the intermediate space 17. All the sensors 41 of the respective sensor strip 39 are switched off, for example, only when the printing unit 01 is in a printing process. As described above, each of the sensors 41 can be embodied as a camera or as a motion detector or as a laser or as a radar system.

As shown in FIG. 5, additionally or alternatively to one of the aforementioned variants, the access control device 33 can also have a mechanical safety barrier 42 on at least one of the longitudinal sides of the printing unit 01, wherein said safety barrier 42 is embodied, for example, in the form of a sliding door, wherein said sliding door, attached to one of the frame parts 13; 14, for example, mounted in a rail, can be displaced lengthwise along the longitudinal side of the printing unit 01, at least on the basis of the movement of the frame parts 13; 14, the position of which relative to one another can be changed, wherein the direction of movement of the safety barrier is indicated in FIG. 5 by a double arrow. Thus the safety barrier 42, in its operating state in which it blocks access to the intermediate space 17, is embodied as having a variable width between the frame parts 13; 14, the position of which relative to one another can be changed. When access to the intermediate space 17 between the frame parts 13; 14, the position of which relative to one another can be changed, and which have been moved away from one another is to be blocked, the sliding door attached to one of the frame parts 13; 14 is connected to the respectively other frame part 13; 14, in that the sliding door is suspended from said part in a lock 43. The lock 43 has an electrical contact switch, for example, which sends a signal to the control unit 28 reporting the blocking of the relevant access to the intermediate space 17 between the frame parts 13; 14, the position of which relative to one another can be changed, and which have been moved away from one another. Then, a probing device 44, for example, a sliding element 44, which can preferably be lowered into and raised out of the base plate of the printing unit 01, can be erected at least in the floor area of the intermediate space 17 and moved through the intermediate space 17 along the width B of the printing unit 01, as indicated in FIG. 5 by a motion arrow, in order to verify that no person or other object, such as a tool or similar object that may have been left behind, is still present in the intermediate space 17 after the safety barrier 42 has been activated. On the side of the sliding element 44 that is directed into the intermediate space 17 at least one contact switch 46 is provided, for example, which is capable of detecting contact with a person or with an object still present in the intermediate space 17. Alternatively, this verification can also be performed in a contactless manner, for example, using optical means, for example, with the sensor 31 embodied as a camera. Once it has been verified that no persons or objects are present in the intermediate space 17, a release signal is sent to the control unit 28, whereupon the control unit 28 actuates the first drive unit 23, whereby the frame parts 13; 14, the position of which relative to one another can be changed, and which have been moved away from one another, are moved toward one another along their adjustment path S, thereby reducing the width of the intermediate space 17 to its minimal value, preferably to zero. The control element 29 arranged in the conduit system 19 for supplying power to the first drive unit 23 can also be controlled by the control unit 28 on the basis of the signal from the probing device 44 that monitors the intermediate space 17 and/or from the safety barrier 42.

The access control device 33 can be permanently or only temporarily present at the respective access point to the intermediate space 17. At least a part of the access control device 33 can have an off-line position and an operational position, wherein in the off-line position, the corresponding part of the access control device 33 is mechanically covered or moved into a protected position, in order to protect it against soiling or damage. The at least one sensor 31 for monitoring the intermediate space 17 and the access control device 33 are activated by the control unit 28, for example, alternatingly, on the basis of the respective operating position of at least the movable frame part 14. As was described above, the control unit 28 immediately halts the movement of the movable frame part 14 when the sensor 31 and/or the access control device 33 detect the presence and/or movement of a body not belonging to the printing unit 01, particularly a press operator, present in a hazardous area of the printing unit 01 which has been created by a movement of the movable frame part 14.

A further improvement of the safety device 18 consists in locating a warning area 47 in front of the intermediate space 17 formed between the frame parts 13; 14, the position of which relative to one another can be changed, which space is monitored by the at least one sensor 31, wherein the warning area 47, which extends particularly along the longitudinal side of the printing unit 01, is scanned either by a sensor 48 provided especially for this purpose (FIG. 4) and/or by the sensor 31 that monitors the intermediate space 17, wherein in this case the scanning zone 37 of the sensor 31 that monitors the intermediate space 17 overlaps with the intermediate space 17. On the basis of the presence and/or movement within the warning area 47 of a body not belonging to the printing unit 01 while the frame parts 13; 14 are interacting, the control unit 28, which is connected to at least one of the sensors 31; 48, will activate a switchover from one operating position of the frame parts to the other, or will halt a movement that has already begun, in the event of a potential hazard. Monitoring the warning area 47 allows the control unit 28 to cause the safety device 18 and/or the drive units 23; 24 and/or the locking system 26 to react quickly when a person approaches the printing unit 01 or at least one of the moving frame parts 13; 14 in a manner that could cause harm to that person. Like the sensor 31 that monitors the intermediate space 17, the sensor 48 specifically for monitoring the warning area 47 is embodied, for example, as a camera or as a motion detector or as a laser or as a radar system, and works, for example, with electromagnetic waves, for example, light or radar, or ultrasonic waves. The sensor 48 that monitors the warning area 47 can have a directional characteristic 32 or a sensing zone 37 having a substantially oval or elliptical cross-section, with which it monitors the warning area 47 in front of the intermediate space 17 formed between the frame parts 13; 14, the position of which relative to one another can be changed.

A further embodiment of the sensor 48 that monitors the warning area 47 can consist of an arrangement of at least one of the sensors 48 that projects into the warning area 47, wherein preferably a plurality of said sensors 48 are arranged particularly close to one another in a row. The sensor 48 is preferably arranged on the movable frame part 14, for example, in the area of the cover plate belonging to said frame part 14, wherein the directional characteristic 32 or the sensing zone 37 of this sensor 48 is oriented particularly vertically downward, such that said sensor 48 will detect a person or an object moving on the side of the movable frame part 14 that faces the intermediate space 17, through the access point to said intermediate space 17 that extends longitudinally along the printing unit 01, and into said space (FIG. 4). A mesh width m between the respective directional characteristic 32 or the respective sensing zone 37 of sensors 48 that monitor the same warning area 47 is only a few millimeters, for example, particularly fewer than 20 mm, preferably from 8 mm to 15 mm. The sensor 48 for monitoring a warning area 47 is positioned at a distance y of fewer than 20 mm, for example, preferably from 8 mm to 15 mm, from an edge 49 of the movable frame part 14, which edge extends vertically, for example, and is formed on the joining surface 16. The depth t of the warning area 47, referred to the longitudinal side of the printing unit 01, and extending in the direction of its width B, is 500 mm to 1,000 mm, for example.

The aforementioned embodiments for monitoring the intermediate space 17 and/or the warning area 47 can also be combined with one another. For example, at least on one side of one of the interacting frame parts 13; 14, a barrier 51 (indicated by dashed lines in FIG. 4) can be permanently or temporarily attached, extending widthwise from said frame part, to which barrier, in turn, a mechanical or contactless safety barrier 42, according to the above-described examples, is arranged, at a lateral distance z from the relevant longitudinal side of the printing unit 01. The distance z corresponds, for example, to the depth t of the warning area 47.

While a preferred embodiment of a printing unit of a printing press comprising at least two frame parts, the position of which relative to one another can be changed, has been described fully and completely hereinabove, it will be apparent to one of skill in the art that various changes, for example, in the specific structure of the printing unit components, the types of materials being printed on, the drives for the printing unit components, and the like could be made without departing from the spirit and scope of the present invention which is accordingly to be limited only by the appended claims.

What is claim is:

1. A printing unit of a printing press comprising at least two frame parts, the position of which relative to one another can be changed, wherein interacting frame parts (13; 14) are placed against one another along a shared joining surface (16) in a first operating position and are moved away from one another in a second operating position, wherein between frame parts (13; 14) that are moved away from one another in the printing unit (01), an intermediate space (17) is formed, delimited in part by said frame parts (13; 14), wherein of the interacting frame parts (13; 14), at least one frame part (14) is arranged so as to be movable along an adjustment path (S), wherein at least one sensor (31) for monitoring the intermediate space (17) is provided, having a directional characteristic (32) effective along the joining surface (16) or having a sensing zone (37) effective along the joining surface (16), wherein a control unit (28) connected to the sensor (31) is provided, characterized in that at least one first drive unit (23) is provided, wherein said drive unit (23) is assigned to at least one of the interacting frame parts (13; 14) in order to change said frame part from one operating position to the other operating position, wherein a control element (29), arranged in a conduit system (19) for supplying power to the first drive unit (23), is controlled by the control unit (28) on the basis of a signal from the sensor (31) that monitors the intermediate space (17), wherein the control element (29) is additionally provided for actuating the first drive unit (23) and is controlled independently from the actuation of the first drive unit (23), wherein a functional position of the control element (29), which can be selected by the control unit (28), prevents relative movement between the frame parts (13; 14).

2. The printing unit according to claim 1, characterized in that the adjustment path (S) is embodied as linear.

3. The printing unit according to claim 1, characterized in that the sensor (31) detects electromagnetic waves or ultrasonic waves.

4. The printing unit according to claim 1, characterized in that the sensor (31) monitors the intermediate space (17) for the presence and/or movement of a body not belonging to the printing unit (01).

5. The printing unit according to claim 1, characterized in that the sensor (31) is embodied as a camera or as a motion detector or as a laser or as a scanner or as a radar system.

6. The printing unit according to claim 1, characterized in that the sensing zone (37) of the sensor (31) carries out a pivoting movement, wherein the sensing zone (37) extends along the joining surface (16) formed between the frame parts (13; 14), the position of which relative to one another can be changed.

7. The printing unit according to claim 1, characterized in that a field width (w) of a first angular field of the directional characteristic (32) or of the sensing zone (37), which width is oriented parallel to the adjustment path (S) of a movable frame part (14), is smaller than a respective field width (u; v) of a second or third angular field of said directional characteristic (32) or said sensing zone (37), wherein the field width (u) of the second angular field of the directional characteristic (32) or the sensing zone (37) is oriented in the axial direction of at least one printing couple cylinder (04) mounted in the movable frame part (14), and the field width (v) of the third angular field of the directional characteristic (32) or the sensing zone (37) is oriented in the direction of a height (H) of the movable frame part (14).

8. The printing unit according to claim 1, characterized in that the control unit (28) connected to the sensor (31) activates the sensor (31) on the basis of the operating positions of the interacting frame parts (13; 14).

9. The printing unit according to claim 1, characterized in that the control unit (28) switches the sensor (31) to mute when the frame parts (13; 14), the position of which relative to one another can be changed, are being moved toward one another, on the basis of the duration of this movement carried out by at least one of the frame parts (13; 14), the position of which relative to one another can be changed.

10. The printing unit according to claim 1, characterized in that the control unit (28) switches the sensor (31) to mute when the frame parts (13; 14), the position of which relative to one another can be changed, are being moved toward one another, once a predefined distance (x) between said frame parts (13; 14) is reached.

11. The printing unit according to claim 10, characterized in that the distance (x) at which the control unit (28) switches the sensor (31) to mute is greater than the first field width (w) of the directional characteristic (32) or the sensing zone (37) of the sensor (31), which width is oriented parallel to the adjustment path (S) of the frame parts (13; 14), the position of which relative to one another can be changed.

12. The printing unit according to claim 1, characterized in that the control unit (28) connected to the sensor (31) evaluates a signal from the sensor (31).

13. The printing unit according to claim 1, characterized in that an access control device (33) connected to the control unit (28) is provided, wherein the access control device (33) controls at least one access point to the intermediate space (17), which remains on one or more sides after the sensor (31) has been switched to mute.

14. The printing unit according to claim 13, characterized in that the control unit (28) activates the access control device (33) no earlier than the start of movement of the frame parts 13; 14, the position of which relative to one another can be changed, and/or no later than simultaneously with the muting of the sensor (31).

15. The printing unit according to claim 13, characterized in that the access control device (33) has one or more photoelectric beam detectors or one or more infrared beam barriers, wherein the respective beam path of the photoelectric beam detectors or infrared beam barriers is oriented horizontally or vertically.

16. The printing unit according to claim 13, characterized in that the access control device (33) exerts a controlling function over the entire height (H) of at least the movable frame part (14) or over only one or more portions of this height (H).

17. The printing unit according to claim 13, characterized in that the access control device (33) is permanently or only temporarily present at the respective access point to the intermediate space (17).

18. The printing unit according to claim 13, characterized in that at least a part of the access control device (33) has an off-line position and a functional position, wherein in the off-line position, the corresponding part of the access control device (33) is mechanically covered or moved to a protected position.

19. The printing unit according to claim 13, characterized in that the control unit (28) alternatingly activates the at least one sensor (31) that monitors the intermediate space (17) and the access control device (33).

20. The printing unit according to claim 13, characterized in that if the sensor (31) and/or the access control device (33) detects the presence and/or movement of a body not belonging to the printing unit (01), the control unit (28) will stop the movement of the movable frame part (14).

21. The printing unit according to claim 1, characterized in that a remotely actuable locking system (26) at least locks the movable frame part (14) in place at least at one of its end points that delimits the adjustment path (S).

22. The printing unit according to claim 21, characterized in that at least one second drive unit (24) is provided, wherein said drive unit (24) is provided for implementing a radial movement of the at least one printing couple cylinder (04) mounted in one of the frame parts (13; 14).

23. The printing unit according to claim 22, characterized in that at least the first drive unit (23) and the second drive unit (24) are supplied with power from the same energy storage device (27).

24. The printing unit according to claim 23, characterized in that the energy storage device (27) is embodied as a hydraulic unit (27).

25. The printing unit according to claim 23, characterized in that the locking system (26) is supplied with power from the same energy storage device (27) as the drive units (23; 24).

26. The printing unit according to claim 23, characterized in that the two drive units (23; 24) are supplied with power by connection to the same conduit system (19) that is supplied with power from the energy storage device (27).

27. The printing unit according to claim 23, characterized in that a control element (34) assigned to the output of the energy storage device (27) is provided, which element can be controlled by the control unit (28) to switch the conduit system (19), which is supplied with power from the energy storage device (27), to pressureless or pressurized.

28. The printing unit according to claim 22, characterized in that the two drive units (23; 24) are actuable each individually and independently of one another.

29. The printing unit according to claim 21, characterized in that if the sensor (31) is not functionally ready and/or functional, the control unit (28) will actuate the locking system (26) for locking the movable frame part (14) in place.

30. The printing unit according to claim 1, characterized in that the control unit (28) stops the movement of the first drive unit (23) as soon as the sensor (31) detects the presence and/or movement of a person in the intermediate space (17).

31. The printing unit according to claim 1, characterized in that the control unit (28) verifies the functional readiness and/or functionality of the sensor (31).

32. The printing unit according to claim 1, characterized in that if the sensor (31) is not functionally ready and/or functional, the control unit (28) will prevent a release that would initiate movement of the movable frame part (14), and/or will stop the first drive unit (23) that drives the movable frame part (14).

33. The printing unit according to claim 1, characterized in that if the sensor (31) is not functionally ready and/or functional, the control unit (28) will actuate the control element (29) arranged in the conduit system (19) for supplying power to the first drive unit (23).

34. The printing unit according to claim 1, characterized in that one of the interacting frame parts (13; 14) is stationary and the other is movable.

35. The printing unit according to claim 34, characterized in that the sensor (31) is attached to the movable frame part (14).

36. The printing unit according to claim 1, characterized in that the control unit (28) is embodied as a control center (28) belonging to the printing unit (01).

37. The printing unit according to claim 1, characterized in that the printing unit (01) imprints a print substrate (02) fed through it in an offset printing process.

* * * * *